US007905034B2

(12) United States Patent
Robinson, Jr. et al.

(10) Patent No.: US 7,905,034 B2
(45) **Date of Patent: *Mar. 15, 2011**

(54) GOLF SHOE OUTSOLE

(75) Inventors: Douglas K. Robinson, Jr., Mansfield, MA (US); James M. Feeney, Marion, MA (US); John J. Erickson, Brockton, MA (US)

(73) Assignee: Acushnet Company, Fairhaven, MA (US)

( * ) Notice: Subject to any disclaimer, the term of this patent is extended or adjusted under 35 U.S.C. 154(b) by 477 days.

This patent is subject to a terminal disclaimer.

(21) Appl. No.: 11/774,733

(22) Filed: Jul. 9, 2007

(65) Prior Publication Data

US 2009/0013561 A1 Jan. 15, 2009

(51) Int. Cl.
*A43B 5/00* (2006.01)
*A43B 13/00* (2006.01)

(52) U.S. Cl. ..... 36/127; 36/134; 36/67 A

(58) Field of Classification Search ..... 36/102, 36/103, 127, 25 R, 67 A, 134
See application file for complete search history.

(56) References Cited

U.S. PATENT DOCUMENTS

| | | | | |
|---|---|---|---|---|
| 1,422,716 | A | 7/1922 | Jones | |
| 3,550,597 | A | 12/1970 | Coplans | |
| 5,797,199 | A | 8/1998 | Miller et al. | |
| 5,926,974 | A | 7/1999 | Friton | |
| 5,979,083 | A | 11/1999 | Robinson, Jr. et al. | |
| 6,018,889 | A | 2/2000 | Friton | |
| 6,023,859 | A * | 2/2000 | Burke et al. | 36/105 |
| 6,161,315 | A * | 12/2000 | Dalton | 36/134 |
| 6,226,896 | B1 | 5/2001 | Friton | |
| 6,694,647 | B1 * | 2/2004 | Patterson et al. | 36/127 |
| 6,817,117 | B1 | 11/2004 | Campbell | |
| 7,143,529 | B2 | 12/2006 | Robinson, Jr. et al. | |
| 2005/0217148 | A1 | 10/2005 | Connolly et al. | |
| 2006/0168847 | A1 * | 8/2006 | Myers et al. | 36/3 B |
| 2006/0248752 | A1 * | 11/2006 | Kittner et al. | 36/69 |

* cited by examiner

*Primary Examiner* — Jila M Mohandesi
(74) *Attorney, Agent, or Firm* — D. Michael Burns

(57) ABSTRACT

The present invention is further directed towards a golf shoe having an outsole comprising of forward and rear base sections that are connected and molded together with an arch support shank. The base sections are relatively soft and made from thermoplastic polyurethane having a maximum Shore A hardness of between 75 to 85. The shank is also made of thermoplastic polyurethane having a minimum hardness of at least 95 Shore A hardness. Each base section has a plurality of openings, wherein a corresponding plurality of relatively hard pods are molded, each pod of a size and configuration to fit within a corresponding opening and extend at least 6.3 mm from the bottom surfaces of the base sections. The shoe provides flexibility both across the metatarsal area and longitudinally at approximately the metatarsal area thereby providing the golfer with improved traction and balance, especially when the golfer executes a golf shot.

10 Claims, 5 Drawing Sheets

GOLF SHOE OUTSOLE

FIELD OF THE INVENTION

The present invention is directed to a golf shoe. More particularly, the present invention is directed to a golf shoe utilizing stability pods to enable greater flexibility, balance, and traction for the golfer.

BACKGROUND OF THE INVENTION

Historically, people first wore shoes to protect their feet. Over the centuries, footwear evolved into many different types that were specific to particular activities. Thus, the protection offered by a cold-weather work boot is highly different from that offered by a running shoe. In addition to protecting the feet, athletic footwear has further developed to offer specific functions dependent on the particular sport. Soccer shoes, for instance, have spikes for traction, whereas cycling shoes have very stiff soles with mounting plates for cleats to engage the pedal. In this manner, golf shoes have evolved to provide the wearer with good traction on grass, comfort while walking, and a stable platform for hitting the ball. Typical golf shoes have had a relatively stiff sole with metal spikes or plastic cleats.

A stiff sole, while providing a stable platform, can nonetheless cause discomfort because there is a balance between how the foot should be allowed to move versus how it should be supported. An example of this is the fact that during walking and at the start and finish of the golf swing, the foot bends at the metatarsal joints (the ball). Aside from the physical effort needed to flex a very stiff sole (which would tend to cause a 'clunky' gait as when wearing clogs), sole stiffness tends to cause the heel of the foot to slide up and down in the heel cup, potentially causing blisters. Thus, golf shoes have evolved to have soles that flex across the ball area to allow this movement without compromising the lateral stability of a good hitting platform.

However, relatively recent studies in biomechanics have sought to better quantify how the 26 bones of the foot move relative to each other during human movements. One particular motion that has been identified is a torsional movement about the long axis of the foot. In effect, the forefoot and rear foot twist relative to each other. It is thought that this movement smoothes the contact between foot and ground, decreasing impacts with the ground as well as providing better ground contact. This observation has led to the development of a golf shoe sole to allow this natural movement.

U.S. Pat. No. 3,550,597 discloses a device that facilitates the natural rolling action of the foot during movement by providing a flat construction with front and rear main lifting sections rigidly connected to a resilient intermediate section that is twisted into the form of a flat torsion spring. The device applies a yieldable torsion action during use that is applied to the foot by the lifting sections, whereby the heel of the foot is urged upwardly at the inner side and the forefoot is raised upwardly at the outer side, producing a torsion action similar to the natural torsion action of the foot.

Another construction intended to provide greater support to the wearer of the shoe is disclosed in U.S. Pat. No. 5,926,974 to Friton. The Friton shoe has a sole that is not designed for golf, but for hiking. It discloses the use of pods and lugs for traction elements that in combination provide greater traction or irregular ground conditions. However, the teachings of this patent are atypical of what is required for a golf shoe. Patent '974 discloses a plurality of pods that are relatively soft, such that they may fan out and serve as compression cushions therein increasing the area of ground contact to improve traction, much the way the hoofs of a mountain goat react. The present invention utilizes relatively hard pods for an entirely different type of terrain.

There remains a need for an improved outsole for a golf shoe that enables an individual movement of the foot, particularly, the rotation between the rear foot and the forefoot, flexing across the foot of the wearer, and also the ability of the shoe to provide flexibility not just across but longitudinally along the metatarsal area of the foot.

SUMMARY OF THE INVENTION

The present invention is further directed towards a golf shoe comprised of an upper and an outsole, with a mid-sole connecting the upper to the outsole. The outsole has a generally soft, and flexible forward and rear base sections, each section having openings of a predetermined size and shape wherein a corresponding like number of stability pods, along with an arch support shank, are molded to the sections to create an outsole. Each stability pod has means for releasably connecting a non-metal cleat for enhanced gripping of turf. The attaching means comprising of a socket containing a cleat receptacle that requires only a 45° clockwise turn to install and a 45° conterclockwise turn to release.

The golf shoe of the present invention uses stability pods made from hard polyurethane having a minimum Shore A hardness of 95. The pods extend at least 6.3 mm from a bottom surface of the outsole. A multitude of relatively hard projections extend outwardly form the bottom surface of the outsole for increased traction.

The forward and rear base sections are made from relatively thin, flexible thermoplastic polyurethane having a Shore A hardness between 75 and 85.

An embodiment of the present invention provides for the forward and rear base sections to be separate pieces and molded together with the arch support shank, wherein the shoe may flex longitudinally as well as across the metatarsal area, thereby providing the golfer with improved flexibility, traction with the turf, and balance, especially when the golfer executes a golf shot.

BRIEF DESCRIPTION OF THE DRAWINGS

To facilitate the understanding of the characteristics of the invention, the following drawings have been provided wherein.

DETAILED DESCRIPTION OF THE PREFERRED EMBODIMENTS

Figure 1:
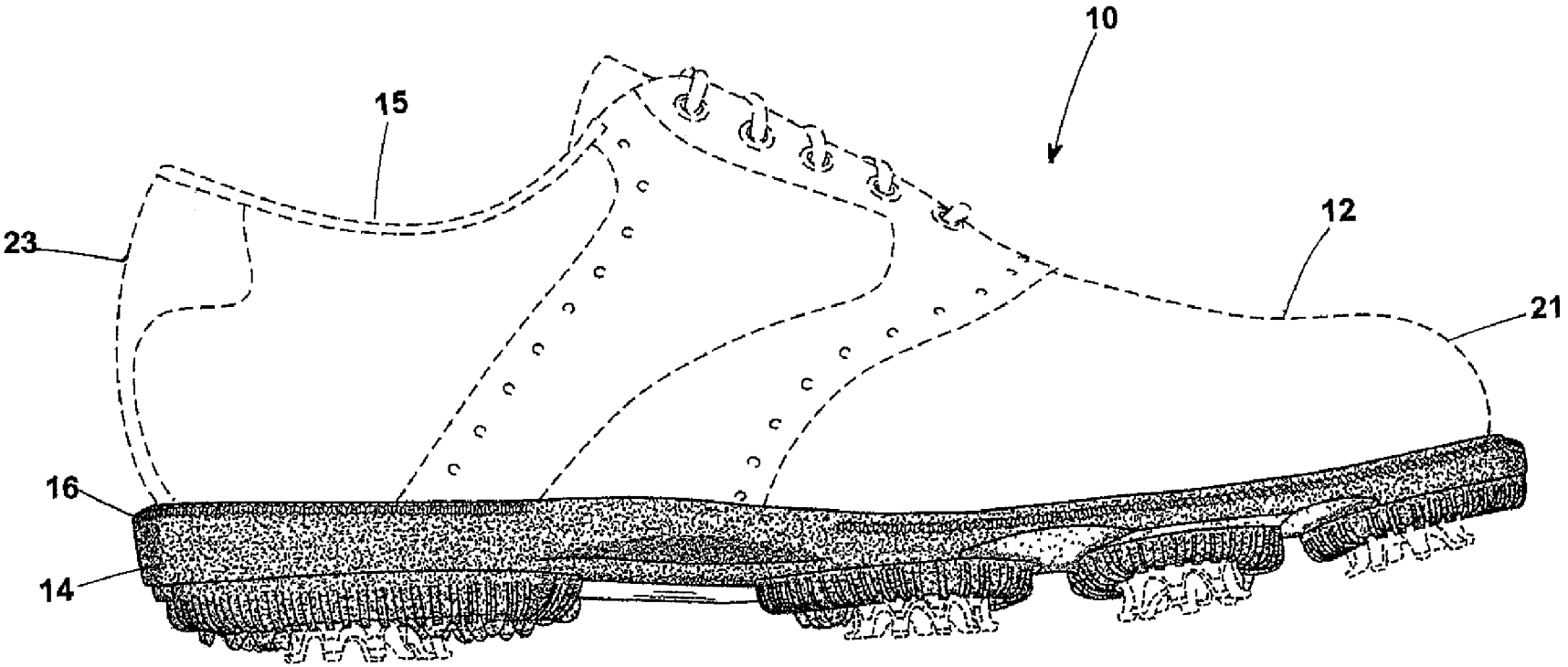
FIG. 1 is a pictorial view of a golf shoe having an outsole.
Figure 2:
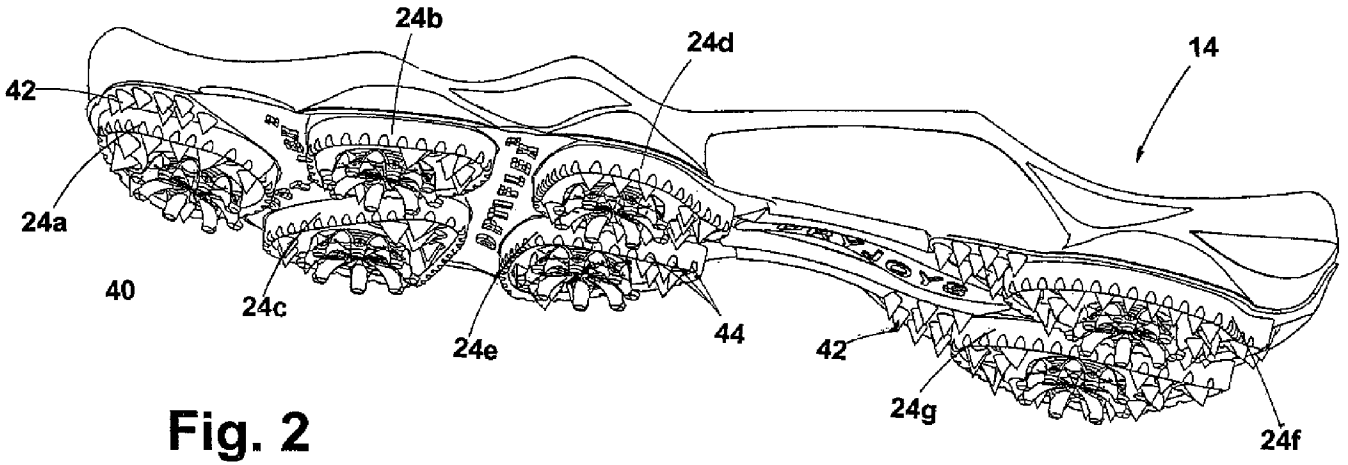
FIG. 2 is a bottom, perspective view of an outsole of the present invention.

As shown in FIG. 1, a conventional golf shoe 10 usually includes an upper 12, an outsole 14, and typically a lightweight, cushioning mid-sole 16, which connects the upper 12 to the outsole 14. Golf shoes may have cleats 40 which can be metal or non-metal, but in discussing the present invention it is to be assumed that only non-metal cleats will be employed. The upper 12 has a generally conventional shape and is formed from a suitable upper material, such as leather or the like. An opening 15 is formed by the top portion of the upper 12 for receiving a user's foot. The mid-sole 16 provides cushioning to the wearer, and is formed of a material such as an ethylene vinyl acetate copolymer (EVA). Mid-soles 16 may be formed on and about outsole 14, but can be formed separately from the outsole 14 and joined thereto such as by adhesive. Once the mid-sole 16 and outsole 14 are joined, the outsole forms a substantial portion of the bottom of shoe 10. Upper 12 is preferably secured to mid-sole 16 with cement or other adhesives using an insole board and conventional techniques, as known by those of ordinary skill in the art.

An embodiment of the invention has an improved outsole 14 which is constructed and shown on FIGS. 2-6. The outsole 14 includes relatively soft and flexible forward and rear base sections 18 and 20. Both base sections 18, 20 have openings of a predetermined size and perimeter shape. Openings 22*a*, 22*b*, 22*c*, 22*d*, 22*e* are located in the forward base section 18 and 22*f* and 22*g* are located in the rear base section 20. Stability pods 24*a*, 24*b*, 24*c*, 24*d*, and 24*e*, having predetermined sizes and configurations, are molded to respective openings 22*a*-22*e*, while pods 24*f* and 24*g* are molded to respective openings 22*f*, and 22*g*. An arch support shank 26 is molded to and interconnects the forward and rear base sections 18 and 20. The base sections 18 and 20 have a top surface 28 and a bottom surface 30, and the bottom surface 30 is configured to contact the turf or ground during use. The bottom surfaces 30 of both sections 18, 20, include a plurality of relatively hard gripping and wear resistant projections 42. The forward part of the shoe 10 is designated as the toe 21 and the rear part as the heel 23.

Each stability pod 24 *a-g* has a socket 32 housing a cleat receptacle for releasably connecting a turf gripping cleat 40 therein. The cleat receptacle only requires a 45° clockwise twist turn to attach, and a 45° reverse turn to release. Turf gripping cleats 40 provide increased traction and balance for the golfer especially when the golfer executes a golf shot. The number of pods and cleats are a function of the shoe style but preferably the number of pods on each shoe is between seven and nine, preferably seven as shown in the drawings herein, with five on the forward base section 18 and two on the rear base section 20. Cleats 40 are preferably non-metallic as most golf courses now make that a requirement for course play.

In a preferred embodiment, the forward and rear base sections 18 and 20 may be formed of flexible plastic material such as thermoplastic polyurethane as manufactured by URE-TECH CO, LTD located in Taiwan under the name Utechilan UTY-75A-85A with a durometer of about 75 to 85 Shore A hardness. The stability pods 24*a-g* are also of a polyurethane material manufactured by Ure-Tech and have a hardness of at least 95 A. The arch support shank 26 is made of a hard plastic having a hardness of at least 95 A.

Figure 3:
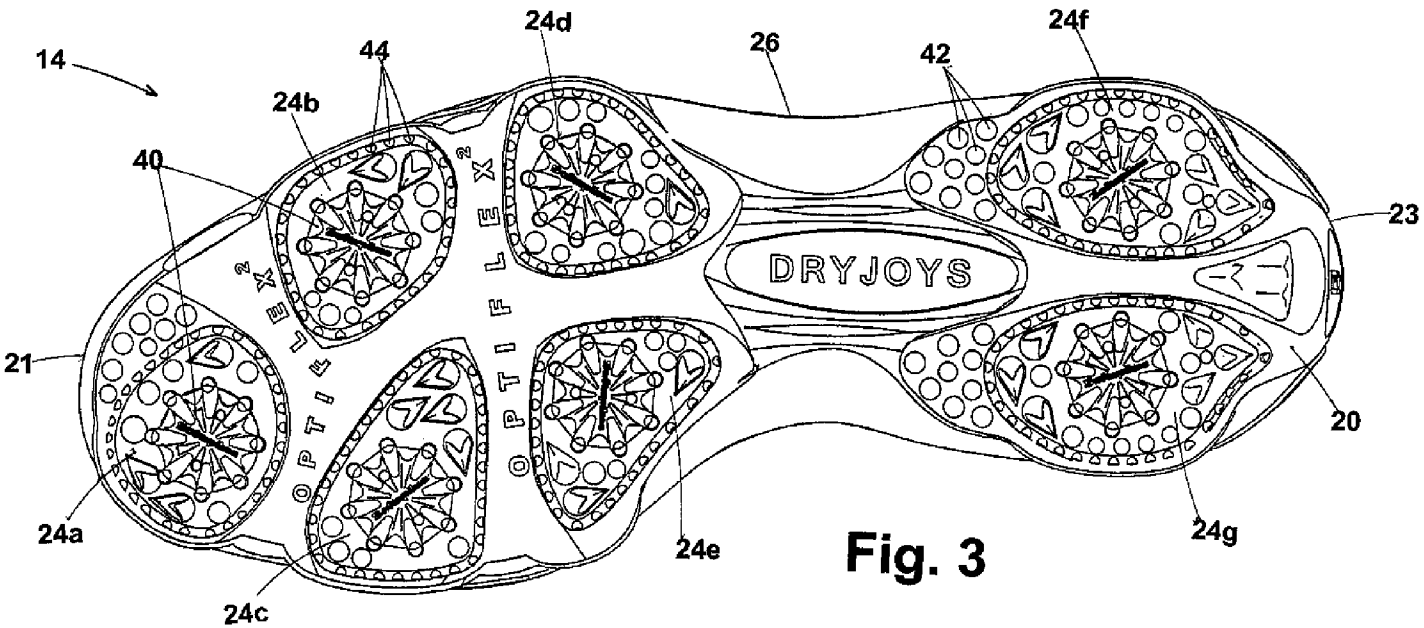
FIG. 3 is a bottom plan view of the outsole of the invention.
Figure 4:
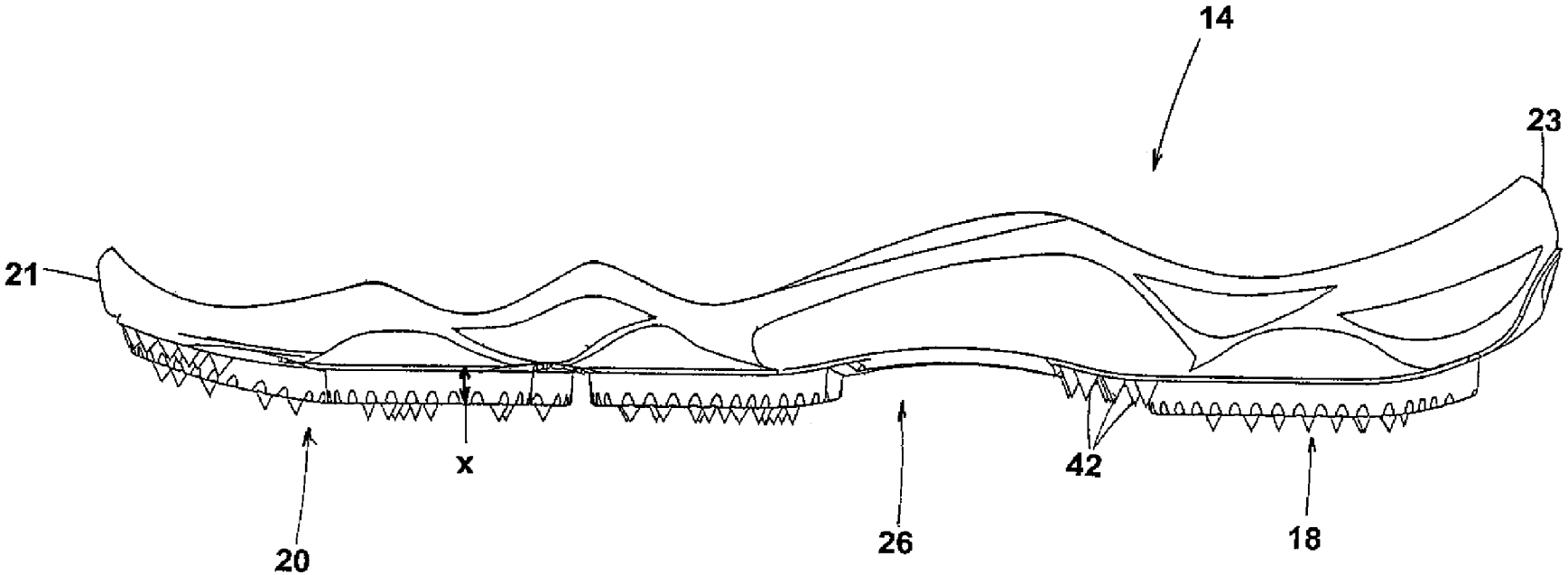
FIG. 4 is a left side elevation view of the outsole of FIG. 3.
Figure 5:
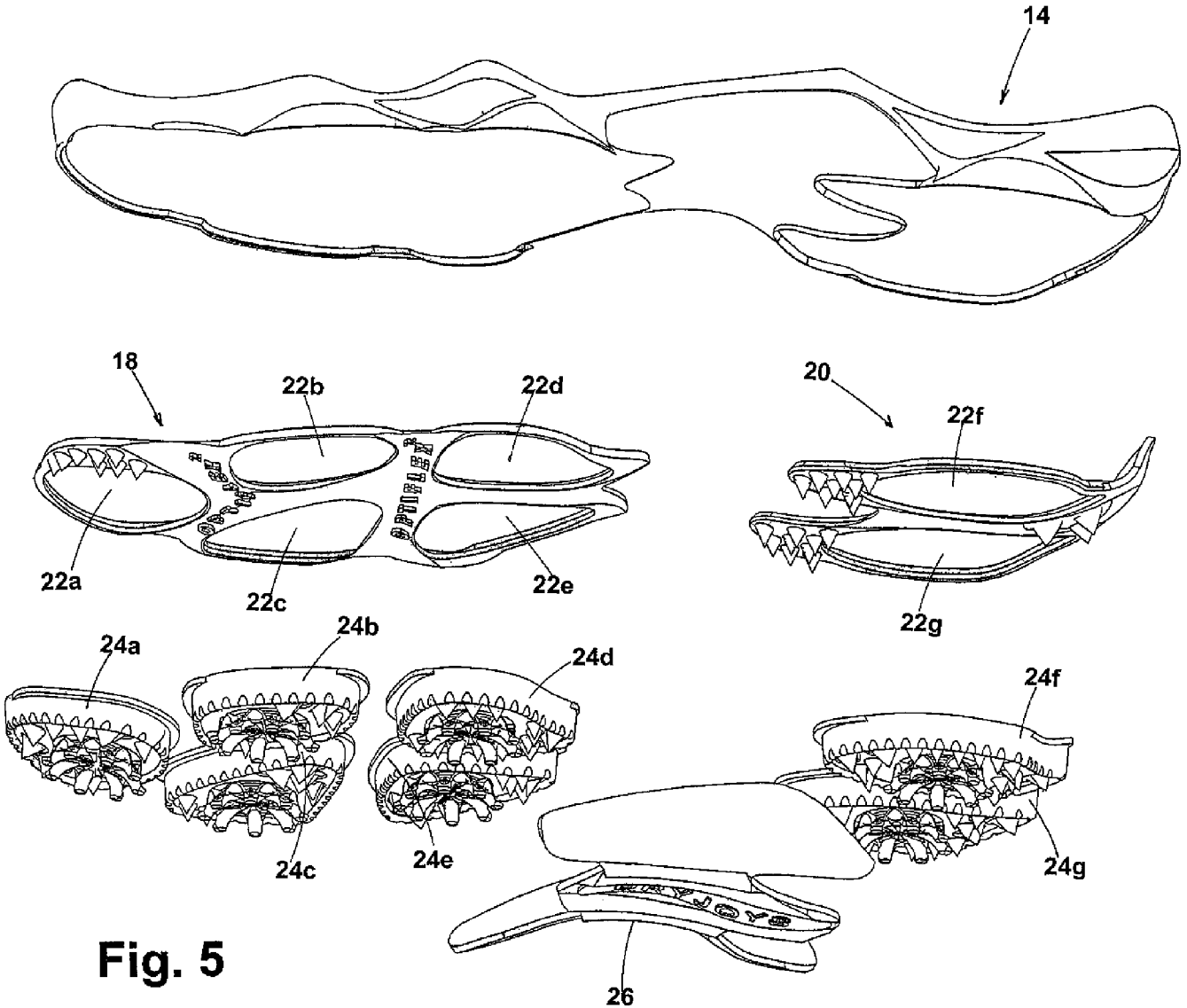
FIG. 5 is an expanded bottom view of the outsole.
Figure 6:
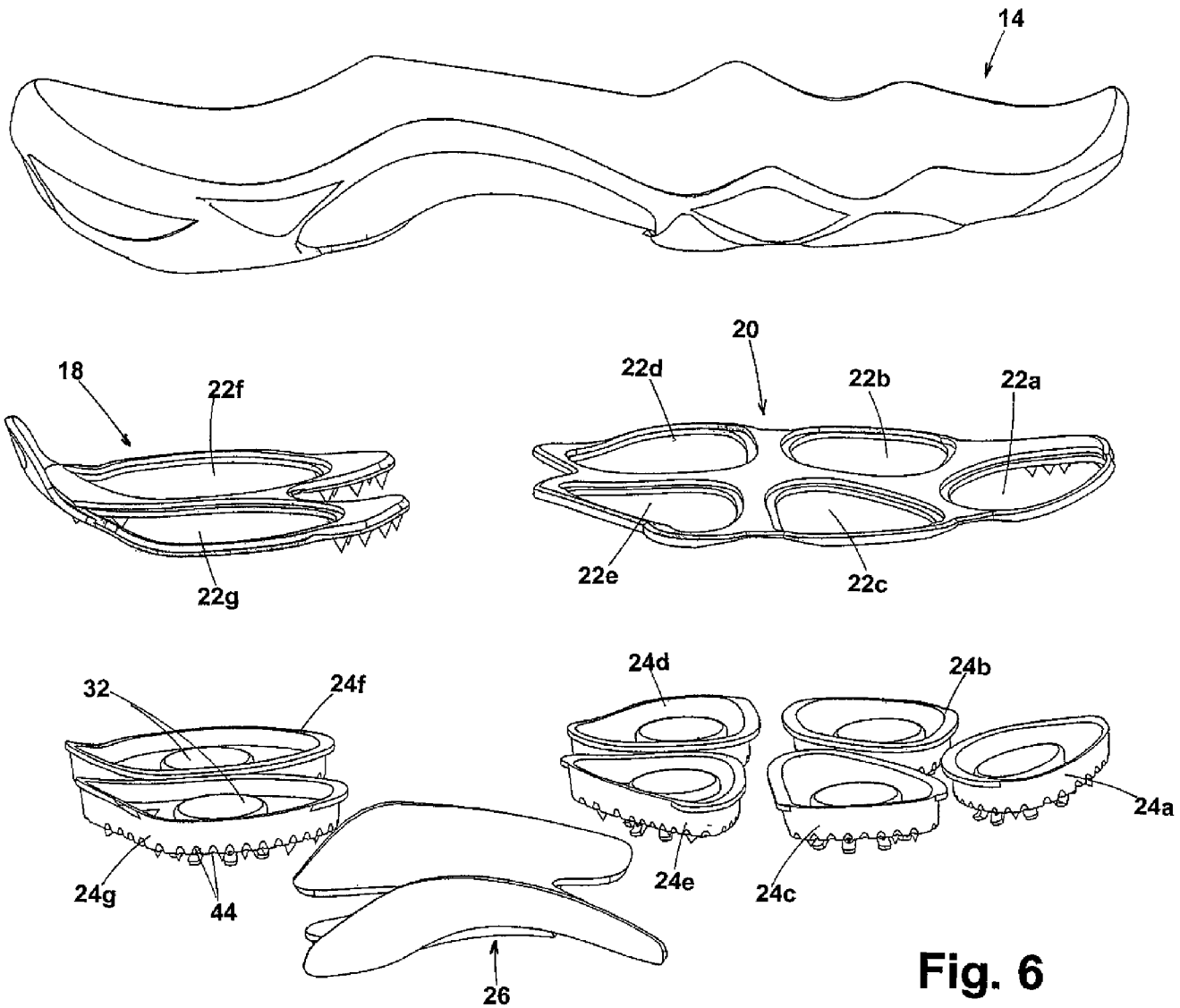
FIG. 6 is an expanded top view of the outsole.

The stability pods 24*a-g* are made of a relatively hard, wear resistant material of at least 95 Shore A hardness. The outer perimeter of the pods extend a minimum distance x of about 6.3 mm from the bottom surface 28 of the forward and rear base sections 18 and 20. The pods 24*a-g*, as best shown on FIG. 3, are of varying dimensions, and are spaced such that they not only allow the forward base section 18 the ability to flex across the metatarsal region, but also allow it the ability to flex longitudinally from the toe 21 to the shank 26. As previously stated, each pod has a cleat releasably attached that provides a measure of traction, which is supplemented by a multitude of relatively hard projections 42 protruding from the bottom surface of each pod. Stability pods 24*a-g* are formed such that the perimeter of each pod defines lugs 44 which provide additional gripping and constructional strength.

While it is apparent that the invention herein disclosed is well calculated to fulfill the objects above stated, it will be appreciated that modifications and embodiments may be devised by those skilled in the art. For example, the outsole 14 and other features thereof discussed above may be used with other types of shoes, not just golf shoes. The appended claims cover all such modifications and embodiments as fall within the true spirit and scope of the present invention.

What is claimed is:

1. A golf shoe comprising:

an upper and an outsole;

a mid-sole connecting the upper to the outsole; and the outsole comprising:

generally thin, soft, and flexible thermoplastic polyurethane forward and rear base sections, each section having a plurality of openings defined therein, each opening having a predetermined perimeter size and shape with a hardness no greater than 75 Shore A ;

a plurality of hard raised stability pods having a minimum of 95 Shore A hardness, each pod of a size and configuration for molding to a corresponding opening and extending at least 6.3 mm from a bottom surface of the outsole;

means in each raised stability pod for releasably attaching a cleat; and an arch support shank molded to and connecting the forward and rear base sections, wherein the shoe will have a greater degree of flexibility because of the soft and flexible outsole and greater stability and balance to the user because of the raised stability pods.

2. The shoe of claim 1, wherein the raised stability pods include a multitude of relatively hard projections extending outwardly for contact with the turf.

3. The shoe of claim 1, wherein there are five raised stability pods molded to the forward base section and two raised stability pods molded to the rear base section.

4. The shoe of claim 1, wherein the forward and rear base sections are separate pieces molded together by the arch support shank.

5. The shoe of claim 1, wherein the attaching means in the raised stability pod comprises a socket containing a cleat receptacle that requires only a 45° clockwise turn to install and a 45° conterclockwise turn to release.

6. An outsole comprising:

a flexible and relatively thin, soft forward base section molded to a soft rear base section by a relatively hard arch support shank:

a plurality of openings in both base sections, each opening having a predetermined perimeter size and shape and each section made from thermoplastic polyurethane having a hardness no greater than 75 Shore A;

a plurality of relatively hard stability raised stability pods molded to the base sections, each pod of a size and configuration to be molded into the perimeter of a corresponding perimeter opening; and each raised stability pod extending a minimum of 6.33 mm from bottom surfaces of the base sections, and an arch support shank molded to and connecting the forward and rear base sections, wherein the shoe will have a greater degree of flexibility because of the soft and flexible outsole and greater stability and balance to the user because of the raised stability pods.

7. The outsole of claim 6, wherein the raised stability pods include a multitude of relatively hard projections extending outwardly for contact with the turf.

8. The outsole of claim 6, wherein there are five raised stability pods molded to the forward base section and two pods molded to the rear base section.

9. The outsole of claim 6, wherein the forward and rear base sections are separate pieces molded together by the arch support shank.

10. The outsole of claim 6, wherein the attaching means in the raised stability pod comprises a socket containing a cleat receptacle requiring only a 45° clockwise turn to install or a 45° counterclockwise turn to remove.

* * * * *